United States Patent [19]

Berz

[11] 4,083,218

[45] Apr. 11, 1978

[54] ARRANGEMENT FOR THE FURTHER TREATMENT OF SECTIONAL STEEL

[75] Inventor: Gerhard Berz, Dusseldorf, Germany

[73] Assignee: Schloemann Siemag Aktiengesellschaft, Germany

[21] Appl. No.: 698,683

[22] Filed: Jun. 22, 1976

Related U.S. Application Data

[62] Division of Ser. No. 580,287, May 23, 1975, abandoned.

[30] Foreign Application Priority Data

May 27, 1974 Germany ..... 2425463

[51] Int. Cl.[2] ..... B21B 39/00; B21B 43/00; B21B 45/02

[52] U.S. Cl. ..... 72/201; 72/228; 72/231; 72/250; 266/111; 266/259

[58] Field of Search ..... 72/160, 163, 161, 183, 72/200–203, 227, 228, 250–252, 231; 83/289, 315, 362; 214/1 P, 1 PB; 242/78.6, 78.7, 78.8, 79, 80; 266/106, 111, 259, 112

[56] References Cited

U.S. PATENT DOCUMENTS

| | | | |
|---|---|---|---|
| 396,925 | 1/1889 | Garrett | 242/79 |
| 627,723 | 6/1899 | Edwards | 266/112 |
| 2,038,917 | 4/1936 | Wilson et al. | 72/200 |
| 2,202,883 | 6/1940 | Yoder | 242/80 |
| 2,508,977 | 5/1950 | Todd | 72/183 |
| 2,516,248 | 6/1950 | O'Brien | 266/259 |
| 2,653,496 | 9/1953 | Anderson | 242/78.8 |
| 3,343,393 | 9/1967 | Groll | 242/78.7 |
| 3,461,703 | 8/1969 | Ranney | 242/78.8 |
| 3,497,084 | 2/1970 | Murrah | 214/1 P |
| 3,837,465 | 9/1974 | Klusmier et al. | 214/1 P |
| 3,922,939 | 12/1975 | Schlueter et al. | 83/315 |

FOREIGN PATENT DOCUMENTS

| | | | |
|---|---|---|---|
| 1,452,471 | 9/1969 | Germany | 242/78.6 |
| 196,693 | 8/1967 | U.S.S.R. | 72/250 |

OTHER PUBLICATIONS

The Making, Shaping and Treating of Steel, 8th Edition, 1964, pp. 776–779.

*Primary Examiner*—E. M. Combs
*Attorney, Agent, or Firm*—Holman & Stern

[57] ABSTRACT

An arrangement for the further treatment of sectional steel stock delivered by a rolling mill includes a coiler unit for coiling the stock emerging from the mill, a cooling conveyor for conveying the coils while cooling them, an uncoiling unit, a section straightening unit for straightening the stock after uncoiling, a cutting unit for cutting the stock into required lengths, a collection station and a collection unit for collecting the straightened, cut lengths of stock at the collection station. Packaging and loading equipment may be used with the collecting devices.

6 Claims, 14 Drawing Figures

Fig. 7
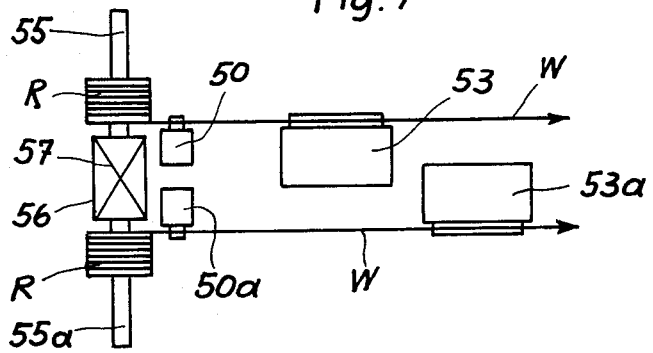
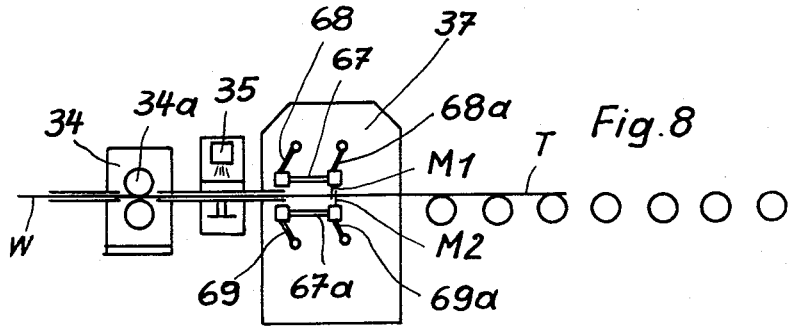
Fig. 8
Fig. 9
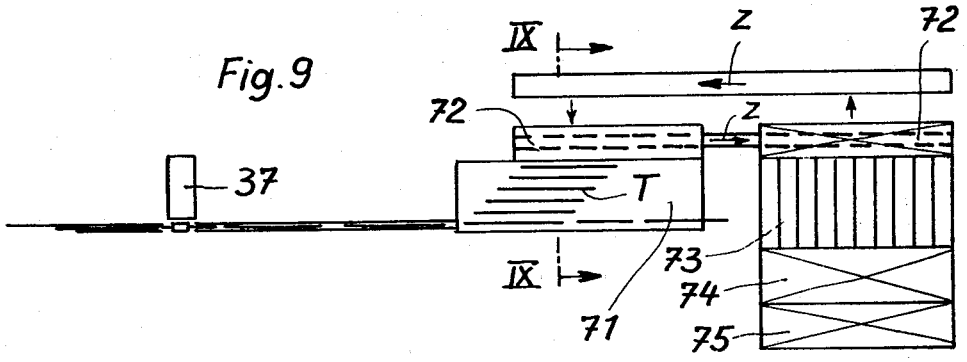
Fig. 9a
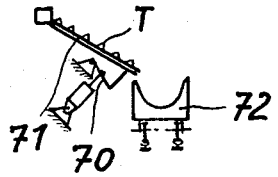

ARRANGEMENT FOR THE FURTHER TREATMENT OF SECTIONAL STEEL

This is a divisional of application Ser. No. 580,287 filed May 23, 1975, now abandoned.

BACKGROUND OF THE INVENTION

The invention relates to an arrangement for the further treatment of sectional steel, wherein the product issuing from the finishing roll train is coiled and is thereupon cooled in that form.

The invention is particularly applicable to rolled stock of relatively small cross-sectional area, i.e. stock that is easily coiled.

According to the present state of the art, small section rolling mills are equipped downstream of the finishing roll train with rotary shears for the purpose of cropping and dividing the lengths of rolled steel. The divided lengths are taken away on conveyor roll tables to one or two cooling beds. After the divided lengths have been conveyed across the cooling bed and cooled, they are passed in groups to single cold shears or pairs of cold shears having the appropriate feed devices for preliminary cutting. These pre-cut lengths are then straightened in straightening machines and cut again to their final size in shears having feed devices and are then passed to the relevant packaging and loading plants.

Such a plant with the above-described machinery for the further and final handling of the product requires very large and extensive factory bays and the expense thereof involves correspondingly heavy investment. There is considerable waste in cropping the ends of the rolled material and a relatively large proportion of subsized lengths so that the product includes a considerable proportion of scrap. Such plants are moreover labor intensive to an unusually high degree and labor costs are consequently very high.

The machines and apparatus mentioned above also have to contend with a plurality of technical problems, which adversely affect their operational reliability or else make much further development work necessary. Examples of such technical problems and requirements are:

1. The need to operate the cooling bed with optimum economy of material;
2. Rotary shears suitable for a rolling speed of 20 m/sec with cropping action when needed;
3. Cooling beds capable of dealing with rolled material fed in at a speed of 20 m/sec and over;
4. Adequate levelling devices;
5. Cold shears of adequate cutting capacity;
6. Automatic devices for inserting cutter blades in the cold shears;
7. Disposal of cropped ends and short lengths of rolled material;
8. Singling and feed-in devices for the straightening machines, and
9. Braking and collecting devices in the rear of the straightening machines.

There must be a satisfactory degree of coordination between all the machinery of the plant which must work in an operationally reliable manner, since breakdowns in individual units can lead immediately to severe losses of production.

SUMMARY OF THE INVENTION

The object of the invention is to provide a plant for the further treatment or working up of small section rolled stock, which reduces the drawbacks of known conventional plants, yields a considerably higher hourly throughput with less scrap and in so doing avoids the hitherto extremely high labor costs ard capital investment, particularly when the plant is handling mainly angle-, flat- and round-section steel.

The invention provides an arrangement for processing rolled sectional steel stock delivered by a rolling mill, the arrangement comprising the following units arranged as a continuous processing line, in the order set forth: a coiler unit for coiling the stock as it emerges from the mill, a cooling conveyor for conveying the coils while cooling them along the processing line, an uncoiling unit, a section straightening unit for straightening the stock after it is uncoiled, a cutting unit for cutting the stock into the required lengths, a collection station, and a collection unit for collecting the straightened, cut lengths of stock at the collection station. If required, packaging and loading equipment is provided for use with the collecting devices.

By means of the above-designated arrangement of machinery and appliances it has become possible to do away with rotary shears in the rear of the finishing roll train and with cooling beds and cold shears and with complicated straightening and correcting gear in the finishing shops.

Thus a considerable saving in capital investment and labor costs is achieved and the use of machinery which is still liable to technical defects is avoided. Furthermore, the hourly throughput of the plant is considerably increased and the production of scrap is very much reduced.

The advantages of finishing shops laid out in this manner are as follows:

1. The space requirements for the plant can be reduced to 20 to 25% of the space required for hitherto customary plants,
2. The capital investment costs for the plant amount to only about 68% of those for conventional plants,
3. The productivity of the plant is increased, since only two croppings are required per rolled billet as compared with from two to 40 croppings hitherto, so that the cropping quota is considerably reduced,
4. Fewer short length sections are produced and these can be more easily disposed of,
5. It is easier to increase the rolling speed of the plant,
6. The manning requirements of the plant are reduced,
7. There is easier insertion of the rolled bars into the straightening machines and the sheering cutters,
8. The finishing shops can operate independently of the actual rolling mills and
9. The plant operating costs are considerably reduced.

In a further feature of the invention Garrett coiling-up groups having winding cages of enlarged diameter are located in the rear of the small section rolling mill. In these groups each end of the input tube to the Garrett coiler is hingedly or telescopically retractable, in order to leave the outer end of the coiled material unbent or straight so as to facilitate insertion thereof into the reverse bending device when the coiled ring is put on to the uncoiling appliance. The coil cooling zone following the coiling-up groups consists essentially of a conveyor belt of known pattern. In order to intensify the cooling effect along the coil cooling zone, water can be sprayed thereonto or air blown thereonto to act as an additional cooling medium.

The uncoiling cages may be mounted in a horizontal axial plane so that the coil is suspended vertically thereon. In order that the coil may be kept in line with the flow line of the reverse bending device, depending on the position of its windings, the uncoiling cages are axially displaceable. In the case of unwinding cages which receive the coils in the flat horizontal position, the axes thereof are mounted in the vertical plane and consequently the winding cages are adapted to be raised and lowered axially vertically in order to adjust the position of the windings to the flow line of the reverse bending device.

The speed of the unwinding motor is controlled independence on the size of the loop of rolled bar unwound off the cage, in order to ensure that this operation takes place without straining the rolled bar. Electrical or optical control devices are provided for the purpose of scanning the size of the loop of rolled bar being unwound, by which means the size of the loop produced on unwinding the relatively stiff rolled bar is limited. A reverse bending device is positioned in a known manner in the rear of the uncoiling cage in the direction of feed of the rolled bar. Alternatively, the uncoiling or unwinding device may be formed from an axially longitudinally extending rotatably mounted arbor receiving the coil of rolled bar and operably connected to a reverse bending device.

Between the reverse bending device associated with the uncoiling device and the following straightening machine there is mounted a funnel-shaped guide member tapering in the direction of the straightening machine. This ensures that the leading end of the coil is smoothly inserted between the guide or straightening rollers of the straightening machine. An arbor could be mounted on both sides of an arbor drive means, in order to unwind two coils simultaneously from one coil unwinding device.

The parting shears provided consist preferably of parallel section shears, for example two-crank or four-crank shears. The collecting device can be a travelling collecting trolley, which is adapted to travel in a closed path between the packaging station and the collecting station. The braking device for retarding the flow of the cut lengths of rolled bar conveyed from the parting shears over a positively driven roll table to the collecting station can be a chute inclined downwardly towards the collecting station. Instead of the chute, a number of slat conveyors can be mounted on the inclined surface leading down to the collecting station. A finishing shop assembly working according to the above-described manufacturing process in the rear of small section rolling mills is particularly suitable when the proportion of sectional steel, for example angle section, flat section and round section steel, predominates in the smaller sized ranges of the production programme.

For requirments of this kind the proposed finishing treatment of the rolled bar offers an economical space-saving alternative guaranteeing a high hourly throughput to the present conventional finishing shop plant operating on the output of small section rolling mills.

Advantageous features of the plant are:

1. The cooling bed is dispensed with; the rolled stock (angle section, flat section and round section) is coiled and cooled in that form on conveyor belts or bands,
2. The cooled section bar is unwound directly from the coils and straightened,
3. Parallel section shears and a pre-positioned measuring roller parting the moving rolled bar are mounted in the rear of the straightening machine, the shears cropping the rolled bar and cutting it into separate (saleable) lengths,
4. The separate lengths are taken off on slat conveyors circulating transversely to the straightening axis and are collected, and
5. These lengths are discharged from the slat conveyors into a chute and can be packaged for dispatch.

BRIEF DESCRIPTION OF THE DRAWINGS

The invention will now be further discribed, by way of example, with reference to the accompanying drawings, in which:

FIG. 7 is a diagrammatic plan view of an uncoiling device with twin arbors, FIG. 8 is a diagrammatic side elevation view of parting shears in the form of four-lever shears, FIG. 9 is a diagrammatic plan view of the collecting station, and FIG. 9*a*** is a diagrammatic side elevation view showing the take-off device including a sloping chute surface.

DETAILED DESCRIPTION OF THE PREFERRED EMBODIMENTS

Figure 1:
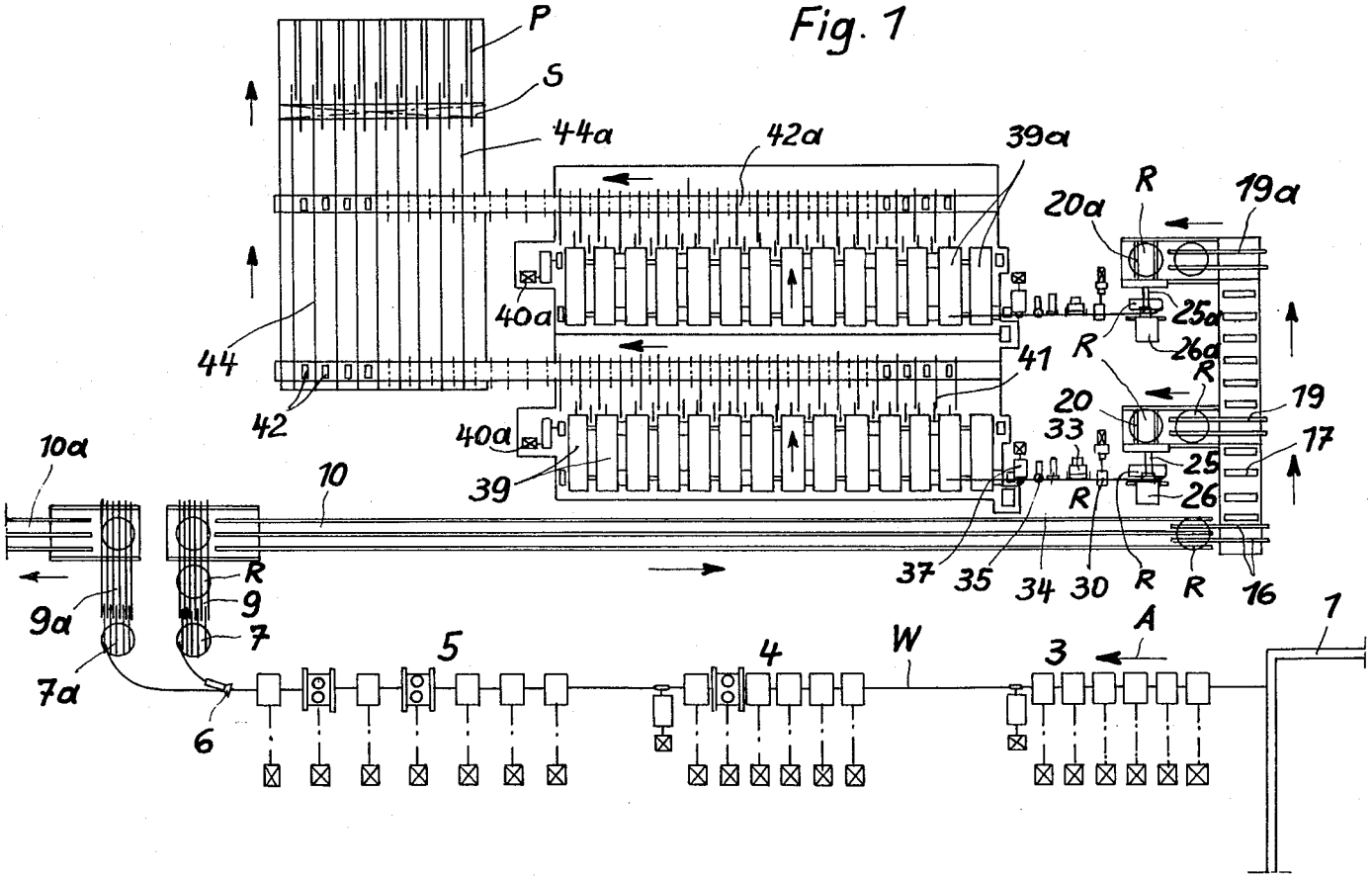
FIG. 1 shows a diagrammatic plan view of an entire plant for the manufacture and finishing of section steel according to the invention.
Figure 2:
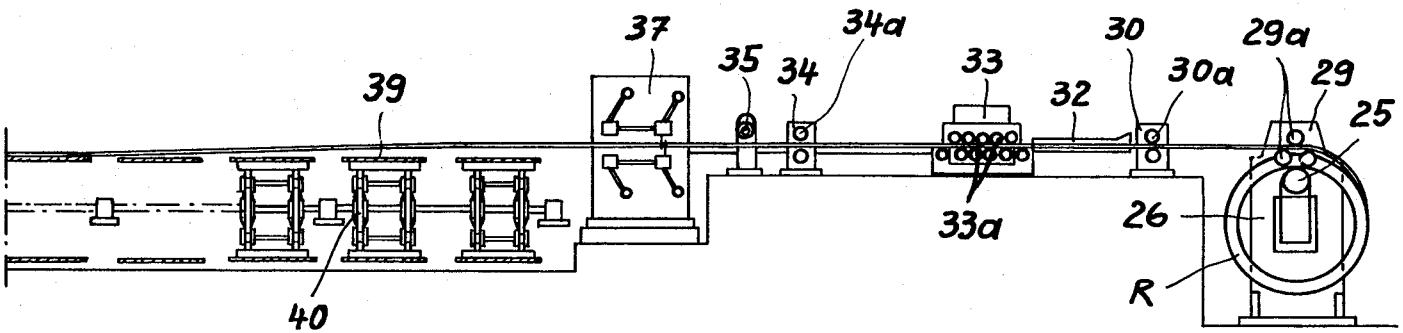
FIG. 2 shows a side elevation view on an enlarged scale of the finishing plant for section steel.
Figure 3:
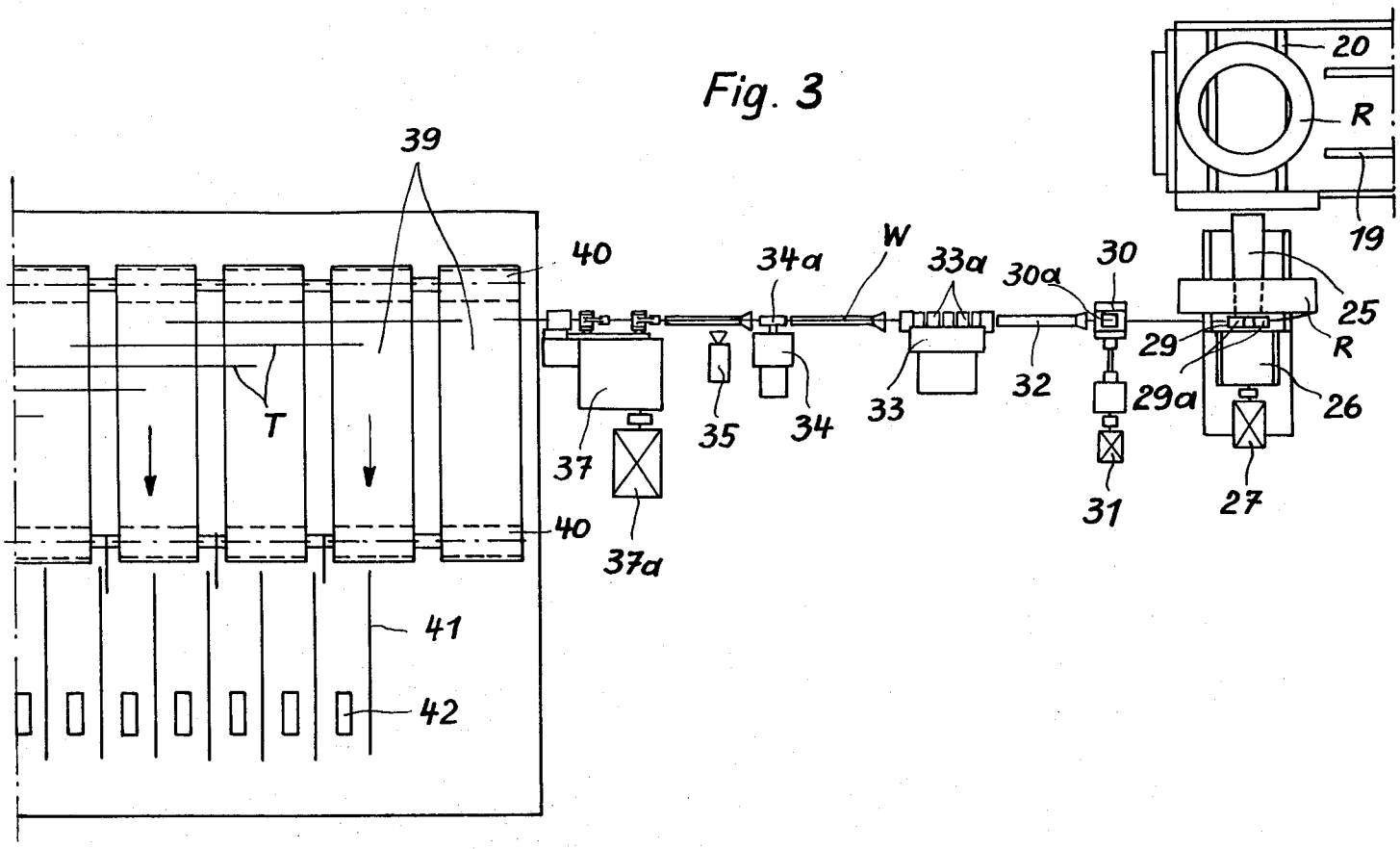
FIG. 3 shows a plan view on en enlarged scale of the finishing plant for section steel.

FIGS. 1 to 3 are general views of the lay-out according to the invention. Referring to FIG. 1, the originating material W, for example in the form of a billet, issues from a furnace 1 in the direction of the arrow A into a continuously operating rolling mill having preliminary roll trains 3, intermediate roll trains 4 and finishing roll trains 5. The preliminary, intermediate and finishing roll trains consist of groups of horizontally or vertically arranged roll stands. The rolled bar W, which may for example be of flat, angular or round section, is alternately deflected by changing over a deflector member 6 from time to time through inlet guides 11, **11*a* to the winding space of Garrett coiling cages 7 and 7*a* respectively. By raising the platform 15 of the Garrett coilers 7, 7*a* the coiled rolled bars R are disengaged from the respective coiling cages of the Garrett coilers 7, 7*a* and fed by means of a coil transport device 9, 9a, such as for example a vibrator or rocker bar conveyor, to the actual coil cooling zone. The coil cooling zones each consist of conveyor belts 10, 10a, which run parallel to one another, for example, as two conveyor lines. Each coil R delivered from the Garrett coilers 7, 7a is transferred from the coil transporters 9, 9a** to these conveyor lines.

As will be seen from FIG. 1, each Garrett coiling device 7 and 7a conveys the respective coils R made thereon to a separate conveyor belt 10 or 10a. As the further treatment both on the conveyor belt 10 and its succeeding installations and on the conveyor belt 10a and its succeeding installations are identical, the following description will be limited solely to the machines in the rear of the conveyor belt 10.

The conveyor belts 10 and 10a constitute the actual cooling zones for the coils R. When they reach the end of the cooling zone the coils R have been cooled to a temperature of about 100° C. The rate of cooling may be accelerated by additional cooling air supply or by water cooling in the last section.

Figures 4, 4A, 4B:
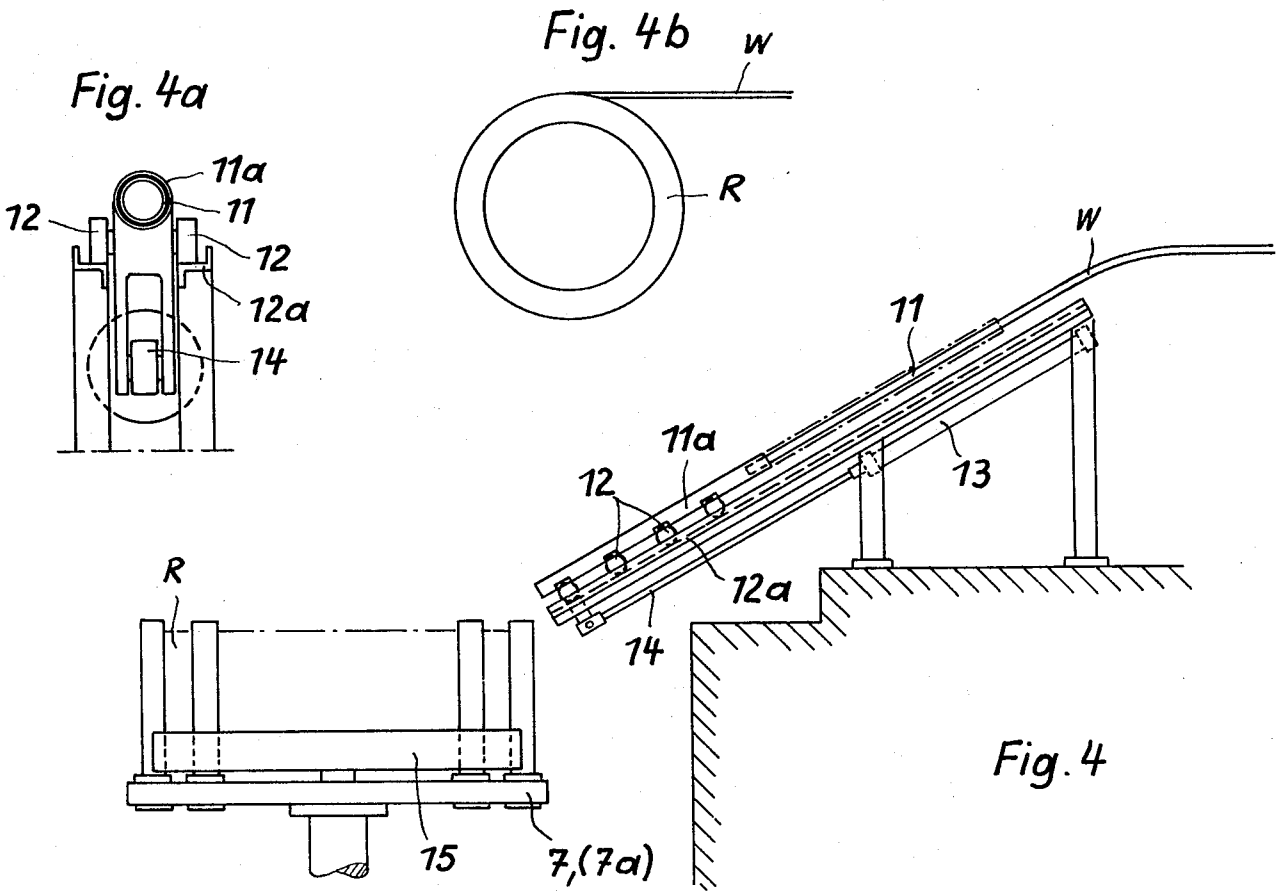
FIG. 4 shows diagrammatically a Garrett coiling device with extensible input guide means, FIG. **4*a* is a cross-sectional view of the inlet guide device.
FIG. 4*b* shows the coiled rolled stock.

As will be seen from FIGS. 4, 4a, 4b, the rolled stock W is fed to the Garrett coiling device 7 or 7a through respective entry guides or inlet tubes 11, 11a which are inclined relatively to the coiling cage. In order to avoid any time-consuming insertion of the end of the coil in the uncoiling device during the subsequent unwinding of the coil R, the inlet guide means is divided into two parts 11 and 11a, the lower portion 11a of which is adapted to be telescoped over the upper part 11. For this purpose the internal diameter of the lower part 11a of the inlet guide is somewhat larger than the outer diameter of the upper portion 11. The lower part 11a is also supported at several places on pairs of rollers 12 in guides 12a and the front end is fastened to a piston rod 14. The piston (not shown) of the piston rod 14 is slidably mounted in a pneumatic lift cylinder 13.

Due to the telescopic construction of the inlet guides 11, 11a to the Garrett coiling device 7, 7a, it is possible to withdraw a length of about 1 to 1.5 meters of the end of the wound coil R as a straight piece from the entry guides 11, 11a (FIG. 4b), by which means the insertion of the end of the stock into the uncoiling and straightening apparatus is facilitated. For the same purpose the lower portion 11a of the inlet guide may also be divided longitudinally in such a way that the upper half of the guide member can be hinged or folded upwardly.

As soon as the coils R have reached the end of the conveyor belt 10, they are transferred by means of a rocker bar conveyor 16 to a roll table 17 having small diameter rolls. The roll table 17 transports the coils R, as is shown in the embodiments, to two parallel uncoiling lines.

Since the further treatment of the coil R in both uncoiling lines is the same, for the sake of simplicity of explanation the further procedure will only be described with reference to one uncoiling line.

Two mutually parallel rocker bar conveyors 19, 19a are located transversely to the direction of movement of the roll table 17, each of which feeds the coil R forward as required from the roll table 17 to a respective tilting frame 20, 20a. The respective tilting frames 20, 20a take up the coils R which are supplied in a horizontal position and turn them up on edge, so that they can be mounted on a horizontally positioned arbor 25, 25a of an uncoiling machine 26, 26a.

Embodiments of these uncoiling machines 26, 26a are illustrated in FIGS. 5, 5a, 6, 6a and 7, concerning the function of which a further description will now be given.

As is illustrated in FIGS. 1, 2, 3, 6 and 6a, the coil R is mounted so as to be suspended on the arbor 25 of the uncoiling machine 26. The arbor 25 is positively driven by a motor 27, in order to effect the unwinding of the rolled stock W. The outer end of the coil R is inserted into a reverse bending appliance 29 formed from three mutually offset bending rollers 29a, which restore the flat profile of the curved material. The unwound material W proceeds further between a pair of driven rollers 30a driven by drive means 30 and 31 and is passed to a set of straightening rollers 33a of a straightening machine 33 via a funnel-shaped guide tube 32 tapering in the direction of the straightening machine 33. After issuing from the straightening machine 33, the straightened bar material W passes through a driven measuring device 34 and close to a photocell 35. The device 34 measures the feed speed of the bar material W and by means, for example, of a pulse source rotationally fast with one of two driven rollers 34a, guiding the bar material W between them, scans the length of the bar material passing through the measuring device 34 in terms of pulses and transmits a signal to a parallel section shears 37 (for example, a four-lever shears) located downstream, for each length of bar material to be parted. As soon as a pre-selected number of pulses arrives in a counting circuit associated with the parallel section shears 37, a section is parted corresponding to a pre-selected length T. This procedure is repeated until the end of the coil R has passed through the measuring driver 34. The photocell 35 located upstream of the parallel section shears 37 initiates the cropping action when the leading end of the coil R passes thereunder. The parted lengths T then pass to a transverse transport system, formed from a number of endless slat conveyors 39, 39a synchronously driven from a common drive 40a, both ends of which pass around guide rollers 40. The slat conveyors 39, 39a withdraw the succession of cut lengths rapidly from the conveyor line while checking their forward motion and transport them via a chute 41, 41a to a discharging roll table 42, 42a. The cut lengths T are conveyed thence over a transverse conveyor 44, 44a to a collecting station S and if desired to a packaging station P.

Figure 5:
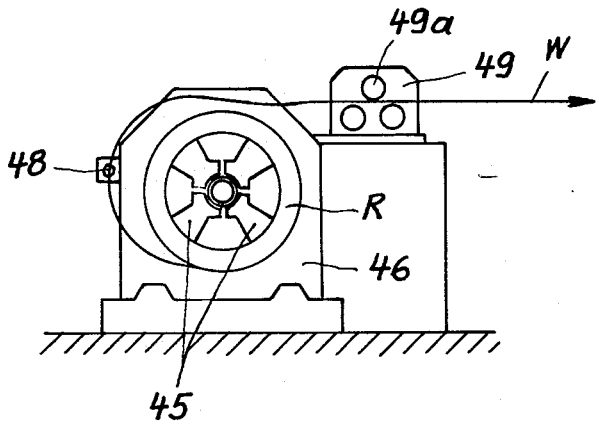
FIG. 5 is a diagrammatic side elevation view of an uncoiling device with a coil positioned vertically thereon.
Figure 5A:
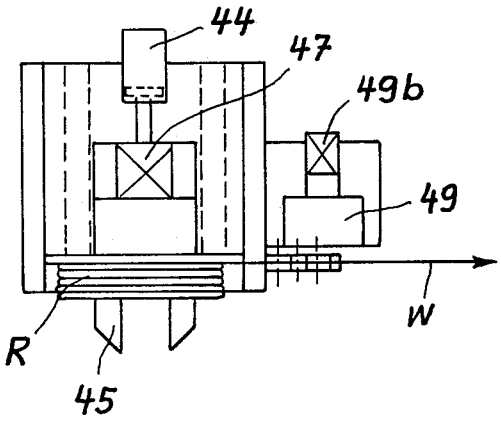
FIG. 5*a* is a diagrammatic plan view of the uncoiling device of FIG. 5.
Figure 6:
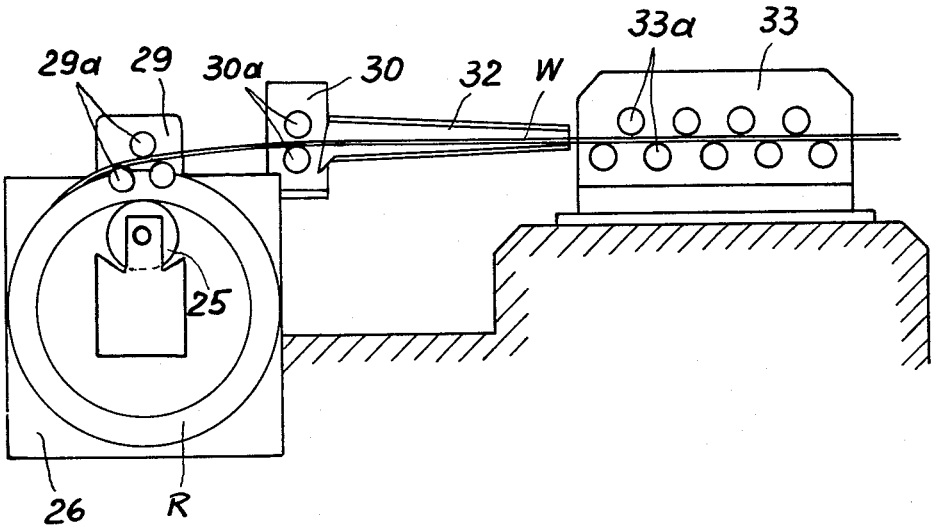
FIG. 6 is a diagrammatic side elevation view of an uncoiling device with an axially horizontal arbor.
Figure 6A:
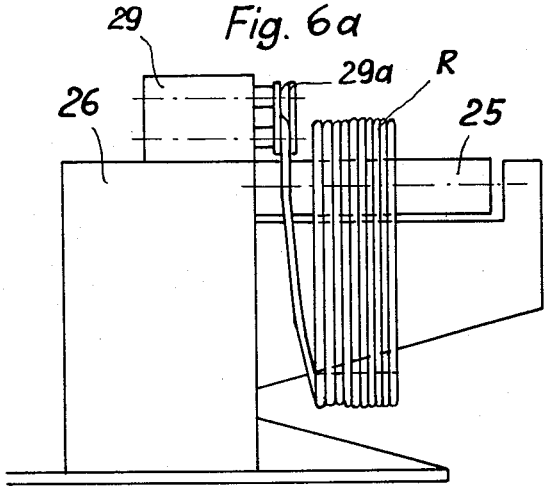
FIG. 6*a* is a diagrammatic rear elevation view of the uncoiling device of FIG. 6.

FIGS. 5, 5a show a further embodiment of an uncoiling machine 46, which can be used instead of the uncoiling machine 26. In the case of the uncoiling machine 46, the coil R is clamped over an expanding arbor 45 and positively driven by a motor 47. A reverse bending driving device 49 with its bending rollers 49a is mounted downstream in the rear of the uncoiling machine 46. Since the coil R is firmly mounted on the expanding arbor 45, the motor 47 of the expanding arbor 45 takes over a substantially portion of the work of uncoiling. In order to relieve the stress on the expanding arbor 45 the uncoiling speed at which the motor 47 drives the arbor 45 is controlled by a photocell 48 so that a loop of approximately constant size is formed, in order to avoid any straining of the bar material between the driving motor 47 of the expanding arbor 45 and the driving motor 49b of the driving device 49 of the reverse bending mechanism. In order to maintain the unwinding layers of the bar material in line with the reverse bending driver 49, the expanding arbor 45 is displaceably mounted in the horizontal plane by means of a displacing drive member 44 such as for example a lift cylinder mounted on its longitudinal axis.

The uncoiling machine illustrated in FIGS. 5 and 5*a* may also be of such design that the rotational axis of the expanding arbor is mounted in the vertical plane and can be raised or lowered accordingly. In that case, the coil R can be placed upon the crown of the expanding arbor. The whole machine would then be installed turned through an angle of 90°.

As is shown diagrammatically in plan view in FIG. 7, the uncoiling machine may also be designed as a double uncoiling machine 56. In that case, a driving motor 57 comprises arbors 55, 55*a* on both sides, on each of which a coil R may be suspended. The arbors 55, 55*a* are preferably of such length that the next coil R can be put in position thereon prior to the end of the uncoiling of each first coil R. A respective powdered guide device 50, 50*a* and a respective straightening machine 53, 53*a* are located downstream of each arbor 55, 55*a*. This uncoiling machine has the advantage that two parallel uncoiling lines can be operated therefrom, so that the material throughput per hour can be doubled.

In FIG. 8 the parallel section shears 37 are designed as four-lever shears. In this case levers 68, 68*a* and 69, 69*a* are operatively connected with oppositely located blade carriers 67 and 67*a* having shearing blades M 1 and M 2 at both ends, the levers being synchronously operated from a driving motor 37*a* and the movement thereof producing parallel cutting of the bar into the fractional or partial lengths T. The use of parallel cut shears is necessary, since the coil R may consist of round section, flat section or angle section steel. The parallel section shears 37 may either be coupled to the continuously running driving motor at each cropping or section cutting operation or they are equipped with a starter motor, which starts up from rest to drive the shears at each cropping or section cutting operation. The cropping operation is initiated when the head end of the roll bar passes the photocell 35, while section cutting is effected by the measuring driver 34 which logs the linear speed of the uncoiled roller bar and compares it with the preselected sectioning length in terms for example of pulses with corresponding control or actuation of the parallel section shears 37.

In FIGS. 9, 9*a* as an alternative to FIGS. 1, 2 and 3, the slowing down of the flow of the section and lengths of rolled bar T along an inclined chute 71 is illustrated. The sectionalized lengths are collected in a collecting trolley 72. The collecting trolleys 72 move in the direction of the arrow Z along a straight path. A vibrator 73 is positioned at the station where the lengths T are discharged from the collecting trolleys 72, which convey the sectionalized lengths T to a stacking station 74 and a baling station 75, where the finished bales of sectionalized lengths T are loaded. During the changeover of collecting trolleys 72 beneath the chute 71, a stopper 70 is swung into the path of the chute 71, which temporarily holds back the descending sectionalized lengths T.

I claim:

1. An arrangement for processing hot-rolled sectional steel stock delivered by a rolling mill, the arrangement comprising the following units arranged as a continuous processing line, in the order set forth:

- a Garrett coiler having a rolled stock entry guide for coiling the hot stock into coils as it emerges from the mill, said entry guide comprising inner and outer telescoping members, said outer member being positioned adjacent to said coiler and being retractible therefrom to effect withdrawal from said guide of a straight length of stock extending from the end of said coil,
- a cooling conveyor for coveying the coils, while cooling them, along the processing line,
- an uncoiling unit comprising a rotatably mounted uncoiling arbor with means for holding a coil with its coil access horizontal,
- a section straightening unit for straighening the stock after it has been uncoiled.
- a parallel cut shear for cutting the stock into required lengths,
- a device associated with the shear for braking and conveying the cut lengths,
- a collection station,
- a collection unit for collecting the straightened, cut lengths of stock at the collection station, and
- a packaging station located downstream from the collection unit.

2. The arrangment as claimed in claim 1, wherein there is more than one processing line, and each line is arranged downstream from the Garrett coiler.

3. The arrangment according to claim 1, wherein a motor is provided to drive the arbor, and the rotational speed of the motor is adapted to be controlled in accordance with the size of the unwound loop of the rolled stock.

4. The arrangement according to claim 3, further comprising an electrical or optical sensing device for scanning the unwound loop of the rolled stock operatively connected to the uncoiling unit.

5. The arrangement according to claim 1, wherein an uncoiling arbor is mounted on each side of the uncoiling unit.

6. The arrangement according to claim 1, wherein the collection unit comprises travelling collecting trolleys adapted to travel in a closed path from the collection station to the packaging station and back to the collection station and wherein the braking device comprises a sloping chute or slat conveyor provided between the conveyor roll table and the collecting trolleys to slow down the flow of rolled stock.

* * * * *